US007892992B2

(12) United States Patent
Kamada et al.

(10) Patent No.: US 7,892,992 B2
(45) Date of Patent: Feb. 22, 2011

(54) POLYVINYL ALCOHOL FIBERS, AND NONWOVEN FABRIC COMPRISING THEM

(75) Inventors: Hideki Kamada, Okayama (JP); Tomohiro Hayakawa, Okayama (JP)

(73) Assignee: Kuraray Co., Ltd., Kurashiki (JP)

( * ) Notice: Subject to any disclaimer, the term of this patent is extended or adjusted under 35 U.S.C. 154(b) by 604 days.

(21) Appl. No.: 10/796,048

(22) Filed: Mar. 10, 2004

(65) Prior Publication Data

US 2004/0180597 A1 Sep. 16, 2004

(30) Foreign Application Priority Data

Mar. 10, 2003 (JP) ..... 2003-063207

(51) Int. Cl.

| | |
|---|---|
| ***D04H 1/00*** | (2006.01) |
| ***D04H 3/08*** | (2006.01) |
| ***D04H 1/46*** | (2006.01) |
| ***D02G 3/22*** | (2006.01) |

(52) U.S. Cl. ..... 442/334; 442/335; 442/337; 442/402; 442/408; 428/364; 428/365; 428/372; 428/397; 428/400; 28/103; 28/104; 28/107

(58) Field of Classification Search ..... 442/334, 442/337, 335, 402, 408; 428/397, 364, 365, 428/372, 400; 28/103, 104, 107
See application file for complete search history.

(56) References Cited

U.S. PATENT DOCUMENTS 3,855,056 A * 12/1974 Maeda et al. ..... 162/157.3
5,166,263 A * 11/1992 Ohgi et al. ..... 525/56
5,208,104 A * 5/1993 Ueda et al. ..... 428/364
5,230,949 A * 7/1993 Howard et al. ..... 442/365
5,972,501 A * 10/1999 Ohmory et al. ..... 428/370
6,485,828 B2 * 11/2002 Deguchi et al. ..... 428/364

FOREIGN PATENT DOCUMENTS

JP 49100327 * 9/1974
JP 49100327 A * 6/1976
JP 9-59872 3/1997

OTHER PUBLICATIONS

Marten, "Vinyl Alcohol Polymers", Encyclopedia of Polymer Science and Technology, published online Mar. 15, 2002.*
U.S. Appl. No. 12/629,973, filed Dec. 3, 2009 Hayakawa et al.
U.S. Appl. No. 10/648,449, filed Aug. 27, 2003 Inada et al.
U.S. Appl. No. 10/796,066, filed Mar. 10, 2004 Kamada.

* cited by examiner

*Primary Examiner*—Angela Ortiz
*Assistant Examiner*—Jennifer Steele
(74) *Attorney, Agent, or Firm*—Oblon, Spivak, McClelland, Maier & Neustadt, L.L.P.

(57) ABSTRACT

Readily-fibrillable fibers of PVA polymer, having good chemical resistance, hydrophilicity, weather resistance and water resistance have a flattened cross-sectional profile and have a mean thickness D (μm) that satisfies the following formula (1):

$$0.4 \leq D \leq 5 \quad (1)$$

wherein D=S/L; S indicates the cross-section area ($\mu m^2$) of the fibers; and L indicates the length (μm) of the major side of the cross section of the fibers. The fibers can be used for making nonwoven fabrics.

29 Claims, 3 Drawing Sheets

【Fig. 1】
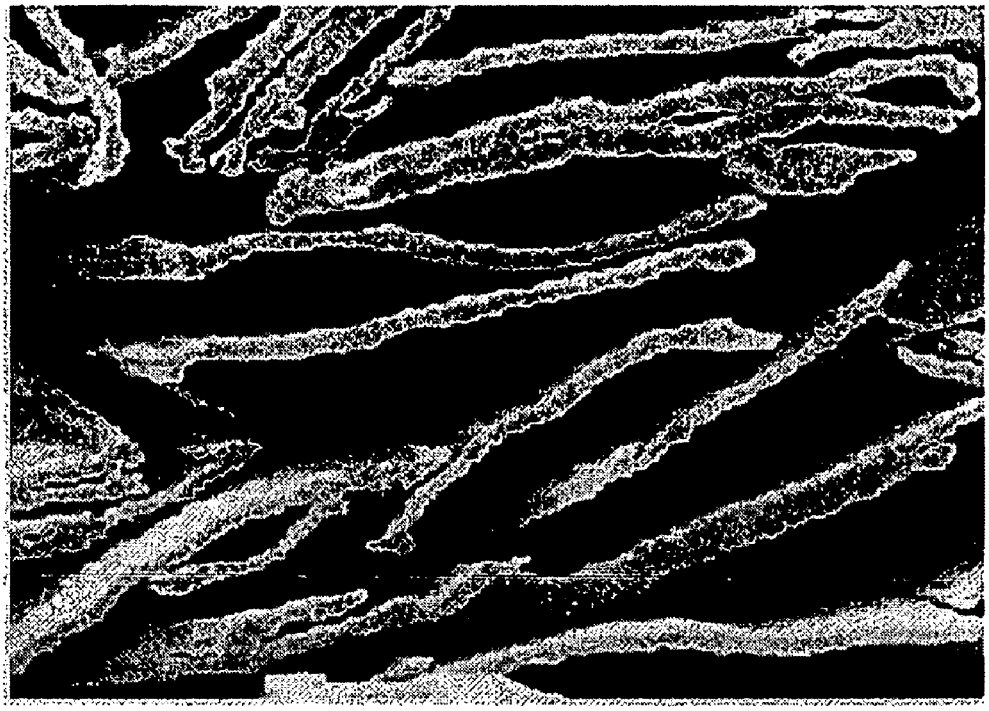
【Fig. 2】
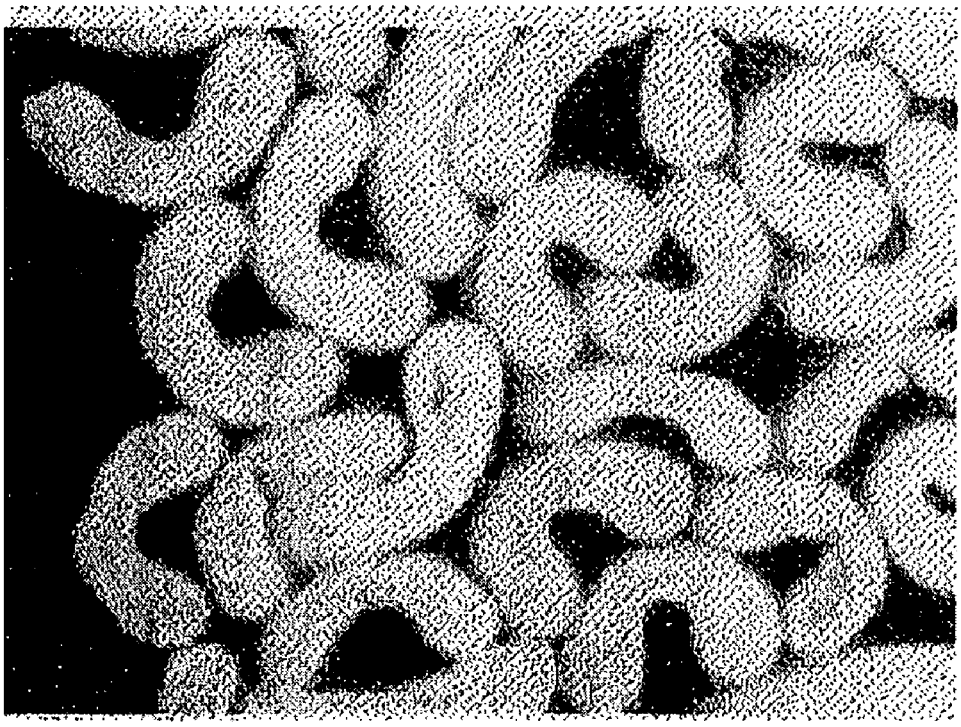

【Fig. 3】
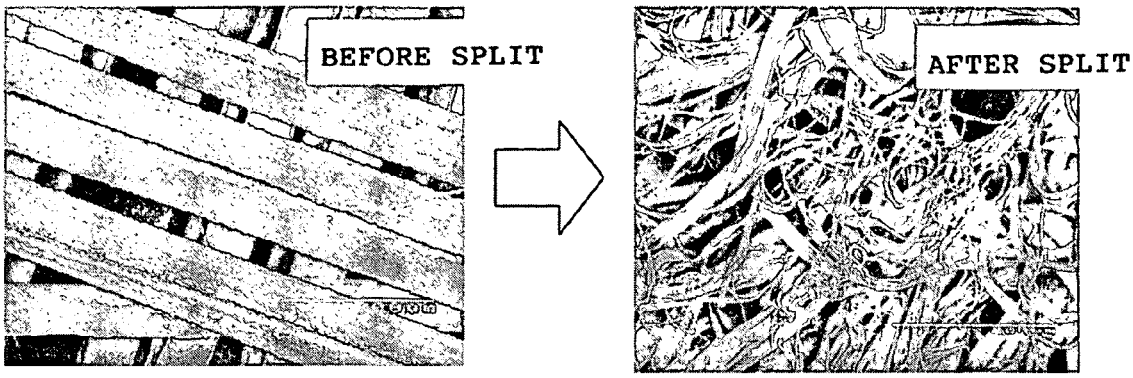

【Fig. 4】
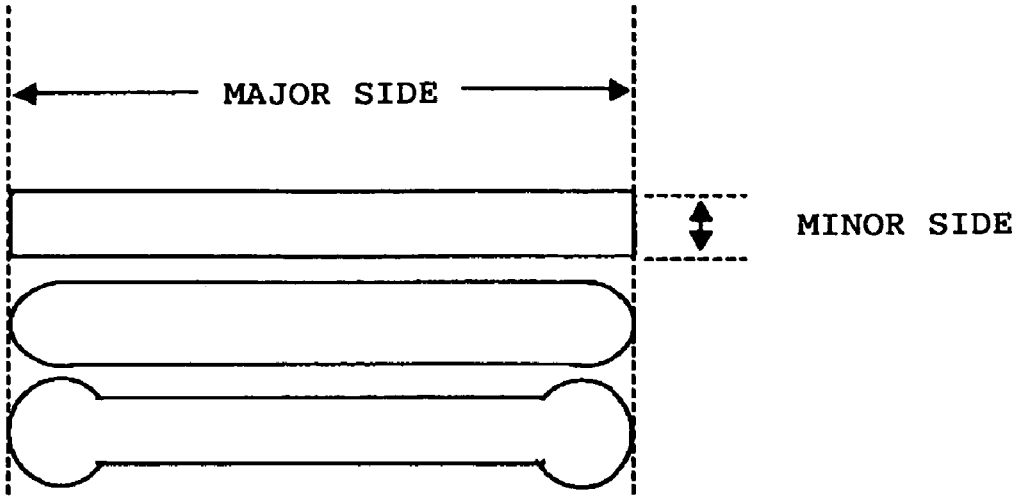

POLYVINYL ALCOHOL FIBERS, AND NONWOVEN FABRIC COMPRISING THEM

BACKGROUND OF THE INVENTION

1. Field of the Invention

The present invention relates to polyvinyl alcohol (hereinafter abbreviated to PVA) fibers having a flattened cross-sectional profile. The fibers are capable of being readily fibrillated. The present invention further relates to a nonwoven fabric comprising the fibers, and to a fibrillated fabric prepared by applying high shear force to the nonwoven fabric.

2. Discussion of the Background

Fibrillated PVA fibers are produced according to a general method that comprises mixing and spinning PVA with other polymer, oil, fat or surfactant immiscible with PVA to make the resulting fibers have a sea-island structure followed by splitting the structure at the interface thereof to give split fibers. For example, a technique has been proposed for it, and is as follows: a PVA polymer is dissolved in a solvent along with other polymer miscible with vinyl alcohol polymer, for example, polyacrylonitrile and/or its copolymer, polymethyl methacrylate, cellulose polymer, starch and the like to form a phase-separated structure in the resulting mixture, then the mixture serving as a spinning solution is wet-spun to give fibers having a sea-island structure, and the fibers are beaten into fibrillated fibers (e.g., see JP-A 49-10617, JP-A 51-17609, JP-A 8-284021, JP-A 8-296121, JP-A 8-81818, JP-A 10-102322, JP-A 10-219515, JP-A 10-219517, JP-A 10-237718).

However, in order to attain sufficient fibrillation in the above-mentioned method, the PVA polymer content of the polymer mixture must be substantially from 30 to 70% by mass. Accordingly, the PVA polymer content of the fibers obtained is low, and the fibers would lose the intrinsic properties of PVA polymer, such as chemical resistance, hydrophilicity, weather resistance and high tenacity. In general, PVA fibers are formalated for making them resistant to water, but the process is problematic in that the fibers are degraded through hydrolysis with strong acid or alkali used for the treatment. When PVA fibers are formalated along with cellulose polymer, it is further problematic in that the polymer mixture is much crosslinked at the interface of PVA polymer/cellulose polymer and, as a result, the fibrilability of the resulting fibers is significantly lowered.

Similarly, a liquid substance such as oil and/or surfactant is dissolved in a solvent along with a PVA polymer to form a liquid mixture having a phase-separated structure, then the resulting mixture serving as a spinning solution is spun in wet into sea-island structured fibers in which the island component is formed of the liquid substance, and the fibers are beaten into fibrillated fibers. According to the method, however, the liquid substance to be added must be at least 30% by mass in order that the fibers produced could be fibrillated. As a result, the liquid substance may flow out in the coagulation bath in the process of wet-spinning, and it may contaminate the bath. For this reason, the industrial production of the fibrillated fibers according to the method is difficult. In addition, a major part of the liquid substance flows out in the coagulation bath, therefore the retention of the substance in the final product is low, and the fibrillation of the fibers is not enough.

On the other hand, for obtaining splittable fibers in a process of melt-spinning different types of polymers that are alternately aligned, for example, a technique of spinning a combination of a PVA polymer and a polyester polymer to give splittable fibers has been proposed (e.g., see JP-A 2001-11736). However, the melt-spinnable PVA polymer is readily soluble in water and is therefore poorly resistant to water, and, in addition, it could not be formalated for improving its water resistance. Accordingly, it is impossible to obtain fibrillated PVA fibers in a process of spinning multiple components in melt.

SUMMARY OF THE INVENTION

It is an object of the present invention to provide polyvinyl alcohol fibers having a flattened cross-sectional profile. The fibers should be capable of being readily fibrillated. It is another object of the present invention to provide a nonwoven fabric comprising the PVA fibers. It is yet another object of the present invention to provide a fibrillated fabric prepared by applying high shear force to the nonwoven fabric.

This and other objects have been achieved by the present invention the first embodiment of which includes polyvinyl alcohol fibers having a flattened cross-sectional profile and having a mean thickness D (μm) that satisfies the following formula (1):

$$0.4 \leqq D \leqq 5 \quad (1),$$

wherein

D=S/L;

S indicates the cross-section area ($\mu m^2$) of the fibers; and

L indicates the length (μm) of the major side of the cross section of the fibers.

In another embodiment, the present invention relates to a method for producing a dry-process nonwoven fabric, which comprises:

applying a water jet of 30 $kg/cm^2$ or more to a web that contains the above fibers, or needle-punching the web to a punching density of at least 250 $kg/cm^2$ to thereby fibrillate the fibers.

In another embodiment, the present invention provides for a dry-process nonwoven fabric obtained according to the above dry-process.

In yet another embodiment, the present invention relates to a method for producing a wet-process water-jet nonwoven fabric, which comprises:

applying a water jet of 30 $kg/cm^2$ or more to base paper prepared from a slurry that contains the above fibers as a part of the fibrous component thereof, to thereby fibrillate the fibers.

In addition, the present invention provides for a wet-process nonwoven fabric obtained according to the above wet-process.

BRIEF DESCRIPTION OF THE DRAWINGS

FIG. 1 is a microscopic photograph showing the cross sections of the PVA fibers of the present invention.

FIG. 2 is a microscopic photograph showing the cross sections of conventional PVA fibers.

FIG. 3 is a microscopic photograph showing the fibrillated condition of the PVA fibers of the present invention after split treatment.

FIG. 4 is a schematic view graphically showing the cross-sectional profile of various spinning nozzles for use in producing the fibers of the present invention.

DETAILED DESCRIPTION OF THE INVENTION

The present inventors have assiduously studied and, as a result, have found that, when PVA fibers are processed to have an extremely flattened cross-sectional profile, then the fibers can be readily fibrillated even though any foreign polymer as in the related art is not added thereto. In addition, the present inventors have further found that, when a layered compound is added thereto, the cross-sectional profile of the fibers may be much more flattened. The present inventors also found that the flattened PVA fibers of the present invention can be fibrillated without compromising their physical properties such as chemical resistance, hydrophilicity, weather resistance and tenacity.

Specifically, the present invention provides PVA fibers having a flattened cross-sectional profile and having a mean thickness D (μm) that satisfies the following formula (1):

$$0.4 \leqq D \leqq 5 \quad (1)$$

wherein D=S/L; S indicates the cross-section area (μm2) of the fibers; and L indicates the length (μm) of the major side of the cross section of the fibers.

Preferably, the PVA fibers of the present invention satisfy the following formula (2):

$$10 \leqq L/D \leqq 50 \quad (2)$$

wherein D indicates the mean thickness (μm) of the fibers; and L indicates the length (μm) of the major side of the cross section of the fibers.

Also preferably, one end or both ends of the flattened cross-sectional profile of the PVA fibers of the present invention are branched. More preferably, the PVA fibers contain from 0.01 to 30% by mass of a layered compound having a mean particle size of from 0.01 to 30 μm.

The present invention also provides a method for producing a dry-process nonwoven fabric, which comprises applying a water jet of 30 kg/cm$^2$ or more to a web that contains the above-mentioned fibers as a part of the component thereof, or needle-punching the web to a punching density of at least 250 kg/cm$^2$ to thereby fibrillate the fibers; and provides the dry-process nonwoven fabric obtained according to the production method.

The present invention further provides a method for producing a wet-process water-jet nonwoven fabric, which comprises applying a water jet of 30 kg/cm$^2$ or more to base paper prepared from a slurry that contains the above-mentioned fibers as a part of the essential fibrous component thereof, to thereby fibrillate the fibers; and provides the wet-process nonwoven fabric obtained according to the production method.

The PVA fibers of the present invention can be readily split into single fibers when having received shear force or the like applied thereto, and therefore can be readily fibrillated not detracting from the physical properties thereof such as chemical resistance, hydrophilicity, weather resistance and tenacity, and the fibrillated fibers can be used for forming dry-process nonwoven fabrics and wet-process nonwoven fabrics. In addition, the dry-process nonwoven fabrics and the wet-process nonwoven fabrics that comprise the fibrillated fibers of the present invention are superior to those comprising conventional fibrillated fibers in point of the water absorption and the wiping potency thereof.

The PVA fibers of the present invention must have a flattened cross-sectional profile. If their cross-sectional profile is cocoon-shaped or roundish like conventionally, then the fibers could not be split when having received shear force applied thereto for splitting them. Even if possible, they could be split into at most two, but could not produce fibrillated fibers that the present invention is to provide. Concretely, the mean thickness D (μm) of the flattened cross section of the fibers, measured with a scanning electronic microscope, must fall within the range that satisfies the following formula (1):

$$0.4 \leqq D \leqq 5 \quad (1)$$

wherein D=S/L; S indicates the cross-section area (μm2) of the fibers; and L indicates the length (μm) of the major side of the cross section of the fibers.

In formula (1), if the mean thickness D of the fibers is over 5 μm, then the fibers could not be split with ease and would require large shear force to be applied thereto for splitting them, and therefore the processability of the fibers will be poor. When the value D is smaller, then the fibers could be more readily split; but if D is smaller than 0.4 μm, then the fibers would be split while they are produced or while they are carded, and the productivity of the fibers will be therefore poor. Preferably, 0.8≦D≦4.5, more preferably 1.5≦D≦4. D includes all values and subvalues therebetween, especially including 0.5, 0.6, 0.7, 0.8, 0.9, 1, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, and 4.9.

For improving the splittability of the fibers, it is desirable that the flattened cross-sectional profile of the fibers satisfies the range of the following formula (2), in addition to the condition of the above formula (1).

$$10 \leqq L/D \leqq 50 \quad (2).$$

The L/D includes all values and subvalues therebetween, especially including 15, 20, 25, 30, 35, 40 and 45. If the value L/D is smaller than 10, then the fibers could be split under shear force applied thereto, but the shear force could not be well transmitted to the fibers and, as a result, the shear force must be increased or the shear time must be prolonged. However, this is unfavorable for efficiently fibrillating the fibers. On the other hand, if L/D is larger than 50, then the flattened cross section of the fibers will be kept folded and therefore the shear force applied to the fibers for splitting them could not be well transmitted to the fibers and, as a result, the fibers would be insufficiently fibrillated, and, in addition, the folded fibers would be entangled together and would be poorly dispersed when they are carded or made into paper in wet. After all, the fibers could not be processed into products of good quality. More preferably, 10≦L/D≦30.

FIG. 1 is a microscopic photograph showing the cross sections of the PVA fibers of the present invention. FIG. 2 is a microscopic photograph showing the cross sections of conventional PVA fibers. It is understood that the cross sections of the conventional PVA fibers in FIG. 2 are cocoon-shaped, but those of the PVA fibers of the present invention are extremely thinly flattened, concretely, satisfying the above formulae (1) and (2) to the effect that the length of the minor size of the cross section is extremely small. More preferably, one or both ends of the flattened cross-sectional profile of the fibers are branched for obtaining nonwoven fabrics that the present invention is to provide. The picture showing the cross sections of the fibers may be taken by the use of a scanning electronic microscope.

The method for producing the PVA fibers of the present invention is not specifically defined. For example, the fibers may be produced in any mode of dry spinning, wet spinning or dry-jet-wet spinning. From the viewpoint of the productivity and the quality of the fibers, wet spinning is preferred. Wet spinning includes two general methods. One is an aqueous wet-spinning method that comprises dissolving a PVA resin in water to prepare a spinning solution followed by spinning out the solution into an aqueous solution of a salt for coagulation, through nozzles to give fibers. The other method is an organic solvent wet-spinning method that comprises dissolving a PVA resin in an organic solvent to prepare a spinning solution followed by spinning out the solution into a bath of an organic solvent for coagulation, through nozzles to give fibers. Any of these methods is employable herein.

The aqueous wet-spinning method is described below. Concretely, a PVA resin is dissolved in water to prepare a spinning solution. The PVA resin is not specifically defined in point of the degree of polymerization thereof. In general, it has a degree of polymerization of from 500 to 4000, but preferably from 1000 to 2500. The degree of polymerization includes all values and subvalues therebetween, especially including 1000, 1500, 2000, 2500, 3000 and 3500. If the degree of polymerization is smaller than 500, then the molecular chains of the resin would poorly tangle with each other and therefore could not be well stretched in the step of drawing the fibers. As a result, the physical properties such as the strength and the water resistance of the fibers would be poor. If, however, the degree of polymerization of the resin is larger than 4000, then the viscosity of the spinning solution comprising the resin will extremely increase. If so, the PVA resin concentration in the spinning liquid must be lowered and the productivity of the fibers will be low. In addition, the volume reduction through water removal from the fibers will be great, and the fibers could not have the intended cross-sectional profile.

The PVA resin for use in the present invention is not specifically defined, and it may be copolymerized with one or more compounds having one or more of the following groups: a carboxylic acid group, a sulfonic acid group, an ethylene group, a silane group, a silanol group, an amino group and an ammonium group. The degree of saponification of PVA for use herein is not also specifically defined. For example, PVA may have a degree of saponification of from 85 to 99.9%, preferably from 96 to 99.9%.

Along with the PVA resin as above, the PVA fibers of the present invention may contain a layered compound added thereto. Containing a layered compound, the fibers could be more readily split. The layered compound is, for example, smectite, montmorillonite or mica. It may be a natural product or a synthetic product. However, in order to be able to add the compound to the spinning solution for the fibers, the mean particle size of the compound preferably falls between 0.01 and 30 μm. The mean particle size includes all values and subvalues therebetween, especially including 0.05, 0.1, 0.5, 1, 5, 10, 15, 20 and 25 μm. If the mean particle size thereof is larger than 30 μm, then the compound may clog spinning nozzles and filters and would interfere with good spinning operation. On the other hand, if the mean particle size thereof is smaller than 0.01 μm, the layered compound particles would aggregate and, as a result, the resulting secondary particles would be larger than tens μm and would clog spinning nozzles and filters, therefore interfering with good spinning operation. More preferably, the mean particle size of the compound is from 0.1 to 10 μm. The amount of the layered compound to be added to the fibers is preferably from 0.01 to 30% by mass of the fibers. The amount of layered compound to be added to the fibers includes all values and subvalues therebetween, especially including 0.05, 0.1, 0.5, 1, 5, 10, 15, 20 and 25% by mass. If the amount is smaller than 0.01% by mass, then the compound would be ineffective for improving the splittability of the fibers. On the contrary, if the amount is larger than 30% by mass, then the spinning nozzle stability would be poor and, in addition, the physical properties of the fibers produced would significantly worsen. More preferably, the amount is from 0.1 to 10% by mass.

Regarding its shape, the nozzle orifice to be used in producing the PVA fibers of the present invention has a slit-like cross section as in FIG. 4. Concretely, the cross section may be rectangular, having a major side of from 180 to 1000 μm and a minor side of from 30 to 80 μm; or may be semi-circularly rounded at the major-side ends of the rectangular form; or may be circularly rounded at the major-side ends of the rectangular form to have a "dog-bone" shape. The cross-sectional profile of the fibers obtained through nozzles does not always correspond to that of the nozzle orifice. Therefore, it is desirable that the ratio of major side/minor side of the cross section of the nozzle orifice falls between 5 and 50. Using the nozzles falling within the range enables the production of the PVA fibers having the intended cross-sectional profile of the present invention. The length of the major side includes all values and subvalues therebetween, especially including 200, 300, 400, 500, 600, 700, 800, and 900 μm. The length of the minor side includes all values and subvalues therebetween, especially including 35, 40, 45, 50, 55, 60, 65, 70 and 75 μm. The ratio of major side to minor side includes all values and subvalues therebetween, especially including 10, 15, 20, 25, 30, 35, 40 and 45.

The spinning solution is passed through the nozzle having the shape as above, and spun out into an aqueous solution of saturated sodium sulfate. Then, the resulting fibers are wound up around a first roller and drawn in wet by 3 to 4 times while they still contain water. Next, these are dried under a constant length condition in a hot air drier at 130° C., and then further drawn under dry heat in a hot air furnace at 230° C. by 2 to 3 times to give the fibers of the present invention. The fibers of the present invention may be used directly as they are. Needless-to-say, however, they may be formalated with formaldehyde to thereby make them resistant to water.

Thus produced, the fibers may be worked in dry into dry-process nonwoven fabrics, according to the method mentioned below.

For example, the fibers are mechanically crimped, then cut into short fibers having a length of from 2 to 100 mm, and carded into a web. The length of the short fibers includes all values and subvalues therebetween, especially including 10, 20, 30, 40, 50, 60, 70, 80 and 90 mm. In forming the web, the fibers of the present invention may be used alone but may be combined with one or more different types of additional fibers such as rayon, polynosic, solvent-spun cellulose, acetate, polyester, nylon, acrylic, polyethylene, polypropylene or cotton fibers. Thus formed, the web is exposed to a water jet of 30 kg/cm$^2$ or more applied thereto, or needle-punched to a density of 250 fibers/cm$^2$ or more. As a result, the PVA fibers of the present invention in the web are split and fibrillated, and a dry-process nonwoven fabric of the present invention is thus obtained as in FIG. 3. Thus obtained, the dry-process nonwoven fabric may be further processed for secondary treatment.

On the other hand, the fibers may be cut into short fibers having a length of from 2 to 20 mm, and they may be wet-sheeted along with binder fibers into a wet-process nonwoven fabric. In this case, the length of the short fibers includes all values and subvalues therebetween, especially including 4, 6, 8, 10, 12, 14, 16 and 18 mm. In this process, the fibers of the present invention may be combined with any other fibers, like those in the above-mentioned dry-process nonwoven fabric. The slurry that contains the fibers of the present invention as at least a part of the component thereof is sheeted into paper, and the resulting paper is exposed to a water jet of 30 kg/cm$^2$ or more applied thereto. As a result, the PVA fibers of the present invention in the paper are split and fibrillated, and a wet-process nonwoven fabric of the present invention is thus obtained as in FIG. 3. Thus obtained, the wet-process nonwoven fabric may be further processed for secondary treatment.

Further, the fibers of the present invention may be beaten with a Niagara beater, a refiner, a pulper or the like beating machine, and a slurry that contains the thus-beaten fibers may be sheeted into a wet-process nonwoven fabric with the fibrillated PVA fibers therein. If desired, the slurry may be sheeted along with a cement slurry into wet-process slates. Also if desired, the fibers of the present invention may be kneaded with a plastic or rubber to produce plastic or rubber products reinforced with the fibrillated PVA fibers.

Having generally described this invention, a further understanding can be obtained by reference to certain specific examples which are provided herein for purposes of illustration only, and are not intended to be limiting unless otherwise specified.

EXAMPLES

In the following Examples, the degree of polymerization of the PVA resin; the mean thickness D of the cross section of the PVA fibers; the cross-section area S of the fibers; the length L of the major side of the cross section of the fibers; the fibrillation processability of the PVA fibers; the hydrophilicity, the chemical resistance, and the wiping potency of the nonwoven fabrics formed of the PVA fibers were measured or evaluated according to the methods described below.

Degree of Polymerization of PVA Resin:

A PVA polymer is dissolved in hot water to have a polymer concentration of from 1 to 10 g/liter (Cv), and the relative viscosity ηrel of resulting polymer solution is measured at 30° C. according to the test method of JIS K6726. The intrinsic viscosity [η] of the polymer is obtained according to the following formula (I), and the degree of polymerization PA thereof is calculated according to the following formula (II).

$$[\eta]=2.303\cdot\log(\eta rel)/Cv \quad \text{(I)},$$

$$PA=([\eta]\times 104/8.29)\times 1.613 \quad \text{(II)}.$$

Mean thickness D (μm) of the cross section of PVA fibers; cross-section area S (μm2) of the fibers; length L (μm) of the major side of the cross section of the fibers:

Measured by the use of a scanning electronic microscope (by Hitachi).

Fibrillation Processability of PVA Fibers:

Using a parallel card, a nonwoven fabric having a weight of 60 g/m2 is produced, and this is exposed to a water jet under a pressure of 90 kgf/cm$^2$. The presence or absence of fibrils in the thus-processed nonwoven fabric is confirmed with a scanning electronic microscope (by Hitachi). The samples in which at least 2 fibers were split from one fiber are judged good.

Hydrophilicity of Nonwoven Fabric:

Using a Klemm-type water-absorbing tester according to the method of JIS P8141, the sample is analyzed and evaluated.

Chemical Resistance of Nonwoven Fabric:

10 g of a nonwoven fabric is sampled, and dipped in 1 liter of an aqueous sodium hydroxide (0.5 mol/liter) solution heated at 60° C., for 8 hours. Then, this is well washed with water, and dried in a hot air drier at 105° C. for 4 hours. Its absolute dry mass a (g) is measured, and the dissolution of the sample is obtained according to the following formula. This indicates the chemical resistance of the nonwoven fabric tested.

$$\text{Dissolution}(\%)=(1-a/10)\times 100.$$

Wiping Potency of Nonwoven Fabric:

A nonwoven fabric is cut into a 5 cm×5 cm piece. With 200 g of a weight put thereon, this is used to wipe off a transparent acrylic plate spotted with 0.15 ml of Indian ink. The transparency A of the original acrylic plate not spotted with Indian ink, and the transparency B of the acrylic plate spotted with Indian ink and wiped with the nonwoven fabric piece are measured by the use of a color-difference meter (Nippon Denshoku Kogyo's Z-300A). The residue after the wiping operation is obtained according to the following formula. The samples of which the difference between the transparency A and the transparency B is smaller are better in point of their wiping potency.

$$\text{Residue after wiping}(\%)=A-B$$

wherein A indicates the transparency (%) of the original acrylic plate not spotted with Indian ink, B indicates the transparency (%) of the acrylic plate spotted with Indian ink and wiped.

Example 1

(1) An aqueous spinning solution of 15% by mass of PVA resin having a mean degree of polymerization of 1700 and a degree of saponification of 99.9 mol % with 0.3% by mass of boric acid was spun out into a coagulation bath of saturated sodium sulfate having a controlled pH of at least 12, through a spinneret with 4000 rectangular slit orifices of 30 μcm (length)×450 μm (width), and the resulting fibers were wound up around a first roller and drawn in wet by 4 times. Then, these were dried at 130° C., and then dried under dry heat at 230° C. by 3 times to give flattened PVA fibers having a single fiber fineness of 1.5 dtex and having D and L/D as in Table 1. Thus obtained, the flattened PVA fibers were acetalized in an aqueous solution of 5% by mass of formaldehyde with 10% by mass of sulfuric acid, for 60 minutes.

(2) The PVA fibers obtained in the above (1) were mechanically crimped, then cut into 51-mm pieces. These were carded to form a web. The web was processed in a water-jet device under a pressure of 60 kg/cm$^2$ to give a dry-process nonwoven fabric having a weight of 90 g/m2. In the thus-obtained nonwoven fabric, the PVA fibers were well fibrillated after the water jet treatment, as in the microscopic photograph of FIG. 3. Further, the hydrophilicity, the chemical resistance and the wiping potency of the nonwoven fabric were all good, as in Table 1.

Example 2

(1) An aqueous spinning solution of 15% by mass of PVA resin having a mean degree of polymerization of 1700 and a degree of saponification of 99.9 mol % was spun out into a coagulation bath of saturated sodium sulfate, through a spinneret with 4000 rectangular slit orifices of 30 μm (length)×600 μm (width), and the resulting fibers were wound up around a first roller and drawn in wet by 4 times. Then, these were dried at 130° C., and then dried under dry heat at 230° C. by 2 times to give flattened PVA fibers having a single fiber fineness of 2.0 dtex and having D and L/D as in Table 1 in the same manner as in Example 1. Thus obtained, the flattened PVA fibers were actualized in the same manner as in Example 1.

(2) The PVA fibers obtained in the above (1) were cut into 10-mm pieces, and 90 parts by mass of the thus-cut fibers were mixed with 10 parts by mass of Kuraray's vinylon binder fibers VPW101, and sheeted in wet. The resulting sheet was processed in a water-jet device under a pressure of 60 kg/cm$^2$ to give a wet-process nonwoven fabric having a weight of 90 g/m2. In the thus-obtained nonwoven fabric, the PVA fibers were well fibrillated after the water jet treatment, as in the microscopic photograph of FIG. 3. Further, the hydrophilicity, the chemical resistance and the wiping potency of the nonwoven fabric were all good, as in Table 1.

Example 3

(1) An aqueous spinning solution of 15% by mass of PVA resin having a mean degree of polymerization of 1700 and a degree of saponification of 99.9 mol % with 0.8% by mass of a layered compound (Corp Chemical's synthetic mica, SIME-88) was spun out into a coagulation bath of saturated sodium sulfate, through a spinneret with 4000 rectangular slit orifices of 30 μm (length)×150 μm (width), and the resulting fibers were wound up around a first roller and drawn in wet by 4 times. Then, these were dried at 130° C., and then dried under dry heat at 230° C. by 2 times to give flattened PVA fibers having a single fiber fineness of 2.0 dtex and having D and L/D as in Table 1. Thus obtained, the flattened PVA fibers were acetalized in the same manner as in Example 1.

(2) The PVA fibers obtained in the above (1) were formed into a dry-process nonwoven fabric in the same manner as in Example 1. In the thus-obtained nonwoven fabric, the PVA fibers were well fibrillated after the water jet treatment, as in the microscopic photograph of FIG. 3. Further, the hydrophilicity, the chemical resistance and the wiping potency of the nonwoven fabric were all good, as in Table 1.

Comparative Example 1

(1) An aqueous spinning solution of 15% by mass of PVA resin having a mean degree of polymerization of 1700 and a degree of saponification of 99.9 mol % was spun out into a coagulation bath of saturated sodium sulfate, through a spinneret with 4000 rectangular slit orifices of 30 μm (length)×120 μm (width), and the resulting fibers were wound up around a first roller and drawn in wet by 4 times. Then, these were dried at 130° C., and then dried under dry heat at 230° C. by 2 times to give flattened PVA fibers having a single fiber fineness of 2.0 dtex and having D and L/D as in Table 1. Thus obtained, the flattened PVA fibers were acetalized in the same manner as in Example 1.

(2) The PVA fibers obtained in the above (1) were formed into a dry-process nonwoven fabric in the same manner as in Example 1. Since the flattened cross-sectional profile (L/D) of the PVA fibers does not satisfy the condition of the present invention, as in Table 1, the fibers could not be well fibrillated even after water-jet treatment. The hydrophilicity and the chemical resistance of the nonwoven fabric were good, but the wiping potency thereof was not good.

Comparative Example 2

(1) An aqueous spinning solution of 15% by mass of PVA resin having a mean degree of polymerization of 1700 and a degree of saponification of 99.9 mol % was spun out into a coagulation bath of saturated sodium sulfate, through a spinneret with 4000 round orifices each having a diameter of 60 μm, and the resulting fibers were wound up around a first roller and drawn in wet by 4 times. Then, these were dried at 130° C., and then dried under dry heat at 230° C. by 2 times to give cocoon-shaped PVA fibers having a single fiber fineness of 0.5 dtex. Thus obtained, the cocoon-shaped PVA fibers were acetalized in the same manner as in Example 1.

(2) The PVA fibers obtained in the above (1) were formed into a dry-process nonwoven fabric in the same manner as in Example 1. Since the PVA fibers had a cocoon-shaped cross-sectional provide, they could not be well fibrillated in water-jet treatment. The hydrophilicity and the chemical resistance of the nonwoven fabric were good, but the wiping potency thereof was not good, as in Comparative Example 1.

Comparative Example 3

(1) A DMSO (dimethylsulfoxide) solution of 8% by mass of polyacrylonitrile resin copolymerized with vinyl acetate of 5 mo % and having a degree of polymerization of 1000 with 12% by mass of PVA resin having a polymerization of 1700 and a degree of saponification of 99.9 mol % was spun out into a coagulation bath of methanol/DMSO (7/3 by mass) at 5° C., through a spinneret with 10000 round orifices each having a diameter of 80 μm, and the resulting fibers were wound up around a first roller. While wet-drawn by 3 times, they were extracted in methanol at 20° C. until the DMSO residue therein could reach 0.1% by mass, and then dried at 150° C. Next, these were further dried under dry heat at 230° C. by 5 times to give PVA fibers having a single fiber fineness of 2 dtex and having a circular cross section.

(2) The PVA fibers obtained in the above (1) were formed into a dry-process nonwoven fabric in the same manner as in Example 1. The PVA fibers were well fibrillated as in Table 1, but the hydrophilicity, the chemical resistance and the wiping potency of the nonwoven fabric formed herein were all inferior to those of the nonwoven fabrics formed of the flattened PVA fibers of the present invention (Examples 1 to 3).

TABLE 1

| | | | | | Hydrophilicity | | | | Wiping Potency | |
|---|---|---|---|---|---|---|---|---|---|---|
| | | | | Fibrillability | Water-Absorbing | | Chemical Resistance | | Residue | |
| | Cross-Sectional Profile | D (μm) | L/D | Microscopic Observation | Speed (mm/5 min) | Result | Dissolution (%) | Result | after Wiping (%) | Result |
| Example 1 | flattened | 3 | 15 | good | 124 | good | <1 | good | 4.0 | good |
| Example 2 | flattened | 3 | 21 | good | 128 | good | <1 | good | 3.1 | good |
| Example 3 | flattened | 3 | 25 | good | 123 | good | <1 | good | 5.0 | good |
| Comparative Example 1 | flattened | 3 | 4 | not good | 125 | good | <1 | good | 14.8 | not good |

TABLE 1-continued

| | | | | | Hydrophilicity | | | | Wiping Potency | |
|---|---|---|---|---|---|---|---|---|---|---|
| | | | | Fibrillability | Water-Absorbing | | Chemical Resistance | | Residue | |
| | Cross-Sectional Profile | D (μm) | L/D | Microscopic Observation | Speed (mm/5 min) | Result | Dissolution (%) | Result | after Wiping (%) | Result |
| Comparative Example 2 | cocoon-shaped | — | — | not good | 111 | good | <1 | good | 15.1 | not good |
| Comparative Example 3 | rounding | — | — | good | 98 | not good | 19 | not good | 9.8 | not good |

The PVA fibers of the present invention may be readily split into single fibers, when having received shear force applied thereto. They can be readily fibrillated without compromising the physical properties such as the chemical resistance, the hydrophilicity the weather resistance and the tenacity thereof. The fibrillated fibers may be formed into dry-process or wet-process nonwoven fabrics. In addition, the dry-process and wet-process nonwoven fabrics formed of the fibrillated fibers of the present invention are superior to those formed of conventional fibrillated fibers in point of the water absorbability and the wiping potency thereof. Further, when the fibrillated PVA fibers of the present invention are sheeted along with a cement slurry, then they may form wet-process slates. When the fibers of the present invention are kneaded with plastic or rubber, then they may form plastic or rubber products reinforced with the fibrillated PVA fibers.

Japanese patent application 63,207/2003 filed Mar. 10, 2003, is incorporated herein by reference.

Numerous modifications and variations on the present invention are possible in light of the above teachings. It is therefore to be understood that within the scope of the appended claims, the invention may be practiced otherwise than as specifically described herein.

The invention claimed is:

1. Polyvinyl alcohol fibers having an extremely flattened cross-sectional profile and having a mean thickness D (μm) that satisfies the following formula (1):

$$0.4 \leqq D \leqq 5 \quad (1),$$

wherein

D=S/L;

D indicates the mean thickness (μm) of the fibers which is a mean length (μm) of the minor side of the cross section of the fibers;

S indicates the cross-section area ($\mu m^2$) of the fibers; and

L indicates the length (μm) of the major side of the cross section of the fibers;

wherein said polyvinyl alcohol fibers consist of polyvinyl alcohol and from 0.01 to 30% by mass of a layered compound having a mean particle size of from 0.01 to 30 μm and wherein said layered compound is smectite, montmorillonite or mica.

2. Polyvinyl alcohol fibers as claimed in claim 1, which satisfy the following formula (2):

$$10 \leqq L/D \leqq 50 \quad (2)$$

wherein

D indicates the mean thickness (μm) of the fibers; and

L indicates the length (μm) of the major side of the cross section of the fibers.

3. Polyvinyl alcohol fibers as claimed in claim 1, wherein one end or both ends of the extremely flattened cross-sectional profile of the fibers are branched.

4. Polyvinyl alcohol fibers as claimed in claim 1, wherein said fibers have a water-absorbing speed of 123-128 mm/5 min.

5. Polyvinyl alcohol fibers as claimed in claim 1, wherein when said fibers are used to wipe off a transparent acrylic plate spotted with Indian ink, a residue after wiping is 3.1 to 5.0%.

6. A dry-process nonwoven fabric, comprising:

the polyvinyl alcohol fibers as claimed in claim 1;

wherein said dry-process fabric is obtained by applying a water jet of 30 $kg/cm^2$ or more to a web that comprises said fibers, or needle-punching the web to a punching density of at least 250 $kg/cm^2$ to thereby fibrillate said fibers.

7. The non-woven fabric as claimed in claim 6, wherein said fibers satisfy the following formula (2):

$$10 \leqq L/D \leqq 50 \quad (2)$$

wherein

D indicates the mean thickness (μm) of the fibers; and

L indicates the length (μm) of the major side of the cross section of the fibers.

8. The non-woven fabric as claimed in claim 6, wherein one end or both ends of the extremely flattened cross-sectional profile of the fibers are branched.

9. A wet-process water-jet nonwoven fabric, comprising:

the polyvinyl alcohol fibers as claimed in claim 1;

wherein said wet-process water-jet nonwoven fabric is obtained by applying a water jet of 30 $kg/cm^2$ or more to base paper prepared from a slurry that comprises said fibers as a part of the fibrous component thereof, to thereby fibrillate the fibers.

10. The non-woven fabric as claimed in claim 9, wherein said fibers satisfy the following formula (2):

$$10 \leqq L/D \leqq 50 \quad (2)$$

wherein

D indicates the mean thickness (μm) of the fibers; and

L indicates the length (μm) of the major side of the cross section of the fibers.

11. The non-woven fabric as claimed in claim 9, wherein one end or both ends of the extremely flattened cross-sectional profile of the fibers are branched.

12. Polyvinyl alcohol fibers having an extremely thinly flattened cross-sectional profile and having a mean thickness D (μm) that satisfies the following formula (1):

$$0.4 \leqq D \leqq 5 \quad (1),$$

wherein

D=S/L;

D indicates the mean thickness (μm) of the fibers which is a mean length (μm) of the minor side of the cross section of the fibers;

S indicates the cross-section area ($\mu m^2$) of the fibers; and

L indicates the length (μm) of the major side of the cross section of the fibers;

wherein said polyvinyl alcohol fibers consist of polyvinyl alcohol and from 0.01 to 30% by mass of a layered compound having a mean particle size of from 0.01 to 30 μm and wherein said layered compound is smectite, montmorillonite or mica.

13. Polyvinyl alcohol fibers as claimed in claim 12, which satisfy the following formula (2):

$$10 \leqq L/D \leqq 50 \quad (2)$$

wherein

D indicates the mean thickness (μm) of the fibers; and

L indicates the length (μm) of the major side of the cross section of the fibers.

14. Polyvinyl alcohol fibers as claimed in claim 12, wherein one end or both ends of the extremely flattened cross-sectional profile of the fibers are branched.

15. Polyvinyl alcohol fibers as claimed in claim 12, wherein one end or both ends of the extremely flattened cross-sectional profile of the fibers are branched.

16. Polyvinyl alcohol fibers as claimed in claim 12, wherein said fibers have a water-absorbing speed of 123-128 mm/5 min.

17. Polyvinyl alcohol fibers as claimed in claim 12, wherein when said fibers are used to wipe off a transparent acrylic plate spotted with Indian ink, a residue after wiping is 3.1 to 5.0%.

18. A method for producing a dry-process nonwoven fabric, said method comprising:

applying a water jet of 30 $kg/cm^2$ or more to a web that contains the fibers of claim 1, or needle-punching the web to a punching density of at least 250 $kg/cm^2$ to thereby fibrillate the fibers.

19. The method as claimed in claim 18, wherein said fibers satisfy the following formula (2):

$$10 \leqq L/D \leqq 50 \quad (2)$$

wherein

D indicates the mean thickness (μm) of the fibers; and

L indicates the length (μm) of the major side of the cross section of the fibers.

20. The method as claimed in claim 18, wherein one end or both ends of the extremely flattened cross-sectional profile of the fibers are branched.

21. A dry-process nonwoven fabric obtained according to the method of claim 18.

22. The nonwoven fabric as claimed in claim 21, wherein said fibers satisfy the following formula (2):

$$10 \leqq L/D \leqq 50 \quad (2)$$

wherein

D indicates the mean thickness (μm) of the fibers which is a mean length (μm) of the minor side of the cross section of the fibers; and L indicates the length (μm) of the major side of the cross section of the fibers.

23. The nonwoven fabric as claimed in claim 21, wherein one end or both ends of the extremely flattened cross-sectional profile of the fibers are branched.

24. A method for producing a wet-process water-jet nonwoven fabric, which comprises:

applying a water jet of 30 $kg/cm^2$ or more to base paper prepared from a slurry that contains the fibers of claim 1 as a part of the fibrous component thereof, to thereby fibrillate the fibers.

25. The method as claimed in claim 24, wherein said fibers satisfy the following formula (2):

$$10 \leqq L/D \leqq 50 \quad (2)$$

wherein

D indicates the mean thickness (μm) of the fibers; and

L indicates the length (μm) of the major side of the cross section of the fibers.

26. The method as claimed in claim 24, wherein one end or both ends of the extremely flattened cross-sectional profile of the fibers are branched.

27. A wet-process nonwoven fabric obtained according to the method of claim 24.

28. The nonwoven fabric as claimed in claim 27, wherein said fibers satisfy the following formula (2):

$$10 \leqq L/D \leqq 50 \quad (2)$$

wherein

D indicates the mean thickness (μm) of the fibers which is a mean length (μm) of the minor side of the cross section of the fibers; and L indicates the length (μm) of the major side of the cross section of the fibers.

29. The nonwoven fabric as claimed in claim 27, wherein one end or both ends of the extremely flattened cross-sectional profile of the fibers are branched.

* * * * *